United States Patent [19]

Barniak et al.

[11] 4,263,785

[45] Apr. 28, 1981

[54] METHOD AND SYSTEM FOR RECOVERING HEAT IN ASSOCIATION WITH DAIRY OPERATIONS

[76] Inventors: Richard L. Barniak, Morgan Gulf Rd., Turin, N.Y. 13473; Roberta F. French, North Country Engineers, Sandy Creek, N.Y. 13145

[21] Appl. No.: 63,956

[22] Filed: Aug. 6, 1979

[51] Int. Cl.[3] ..... F25B 7/00; F25B 27/02

[52] U.S. Cl. ..... 62/79; 62/335; 62/238.6; 165/66

[58] Field of Search ..... 62/238 E, 335, 79; 165/48 R, 66; 98/33

[56] References Cited

U.S. PATENT DOCUMENTS

| | | | |
|---|---|---|---|
| 2,797,068 | 6/1957 | McFarlan | 62/335 |
| 4,104,890 | 8/1978 | Iwasaki | 62/335 X |
| 4,148,355 | 4/1979 | Gehring | 62/238 E |
| 4,149,389 | 4/1979 | Hayes et al. | 62/79 |
| 4,184,538 | 1/1980 | Rauenhorst | 165/66 |

FOREIGN PATENT DOCUMENTS

| | | | |
|---|---|---|---|
| 1476954 | 9/1969 | Fed. Rep. of Germany | 62/238 E |
| 2133227 | 9/1978 | Fed. Rep. of Germany | 62/238 E |

*Primary Examiner*—Lloyd L. King

*Attorney, Agent, or Firm*—Charles S. McGuire

[57] ABSTRACT

Body heat given off by cows in an enclosed barn during periods of outside temperature requiring residential heating is utilized as the heat source in a first refrigeration circuit, and heat absorbed from the milk is used as the source for a second refrigeration circuit. Water used in the residential heating system absorbs heat from the refrigerants of both circuits in a double tube condenser. One circuit may also be used as a pre-heater for domestic hot water.

11 Claims, 3 Drawing Figures

METHOD AND SYSTEM FOR RECOVERING HEAT IN ASSOCIATION WITH DAIRY OPERATIONS

BACKGROUND OF THE INVENTION

The present invention relates to recovery and utilization of heat naturally produced in the course of dairy operations wherein cows are housed and milked in an enclosed barn. More specifically, the invention relates to refrigeration circuits for absorbing heat generated by the body heat and the milk of dairy cattle and giving up the heat to water used in residential heating and/or domestic hot water.

It is a common practice in northern climates to keep dairy cattle housed in a barn essentially continuously during the winter months, aside from relatively brief exercise periods. The body heat generated by the cows raises the temperature within the barn to a level considerably above that of the outside temperature. For example, it is not uncommon for the temperature inside a dairy barn to be 65° F. when the outside temperature is as low as 0° F. without providing any heat to the barn other than that of the cows' body heat.

When milk is to be stored for any significant period of time it is necessary that it be cooled. To this end, milk cooling tanks are provided in a wide variety of models and capacities. In some cases, heat absorbed in the cooling coils is usefully employed in heaters or pre-heaters for water to be used in connection with the dairy operation or for other domestic purposes.

It is a principal object of the present invention to provide a novel heating method and system which recovers and usefully employs body heat given off by cows in an enclosed dairy barn, as well as heat absorbed during cooling of the milk from such cows.

Another object is to provide means for supplementing an existing residential heating system with animal body heat which is not otherwise usefully employed.

A further object is to provide a waste heat utilization system employing two separate refrigeration circuits for absorbing heat from two sources, both associated with a dairy operation.

In a more general sense, the object of the invention is to provide heating methods and systems which recover and utilize in an energy saving manner naturally available heat which is otherwise wasted.

Other objects will in part be obvious and will in part appear hereinafter.

SUMMARY OF THE INVENTION

In accordance with the foregoing objects, the invention contemplates a system wherein the evaporator coil of a first refrigeration circuit is placed in a dairy barn with a suitably sized fan to circulate air at the inside barn temperature over the coil. The refrigerant with which the first circuit is charged is heated to at or near the barn air temperature, which is elevated above outside temperature by the body heat of the cows, and is then compressed to a level raising its temperature to, e.g., 130°–160° F. The heat is given up in a condensing tube or coil and the refrigerant liquid is returned to the barn evaporator coil.

Milk obtained in the dairy operation is cooled in a tank having cooling coils which serve as the evaporator of a second refrigeration circuit. The refrigerant in the second circuit, not necessarily of the same type as that in the first circuit, is likewise compressed to a level raising its temperature to the same level as the condenser temperature of the other refrigerant. The condensing tubes or coils of both the first and second circuits are located in the same tank, through which water is circulated to pick up heat from the two condenser tubes. Thus, the system is in the nature of double-tube, counter-flow type condensing unit.

The water heated in the condenser is used for residential heating, with heat transfer being effected by any conventional means. A bypass line may be provided in one of the circuits, preferably the one incorporating the milk cooling system, for diverting some or all of the heated refrigerant to a heater or pre-heater for domestic hot water prior to entering the double-tube condenser. An outside air temperature sensor regulates the temperature of the water leaving the double-tube condenser to the level required to effect the desired heating. Head pressure controls are provided for both circuits and all connections and controls for the double-tube condenser system are conveniently provided in a single package.

DETAILED DESCRIPTION

Figure 1:
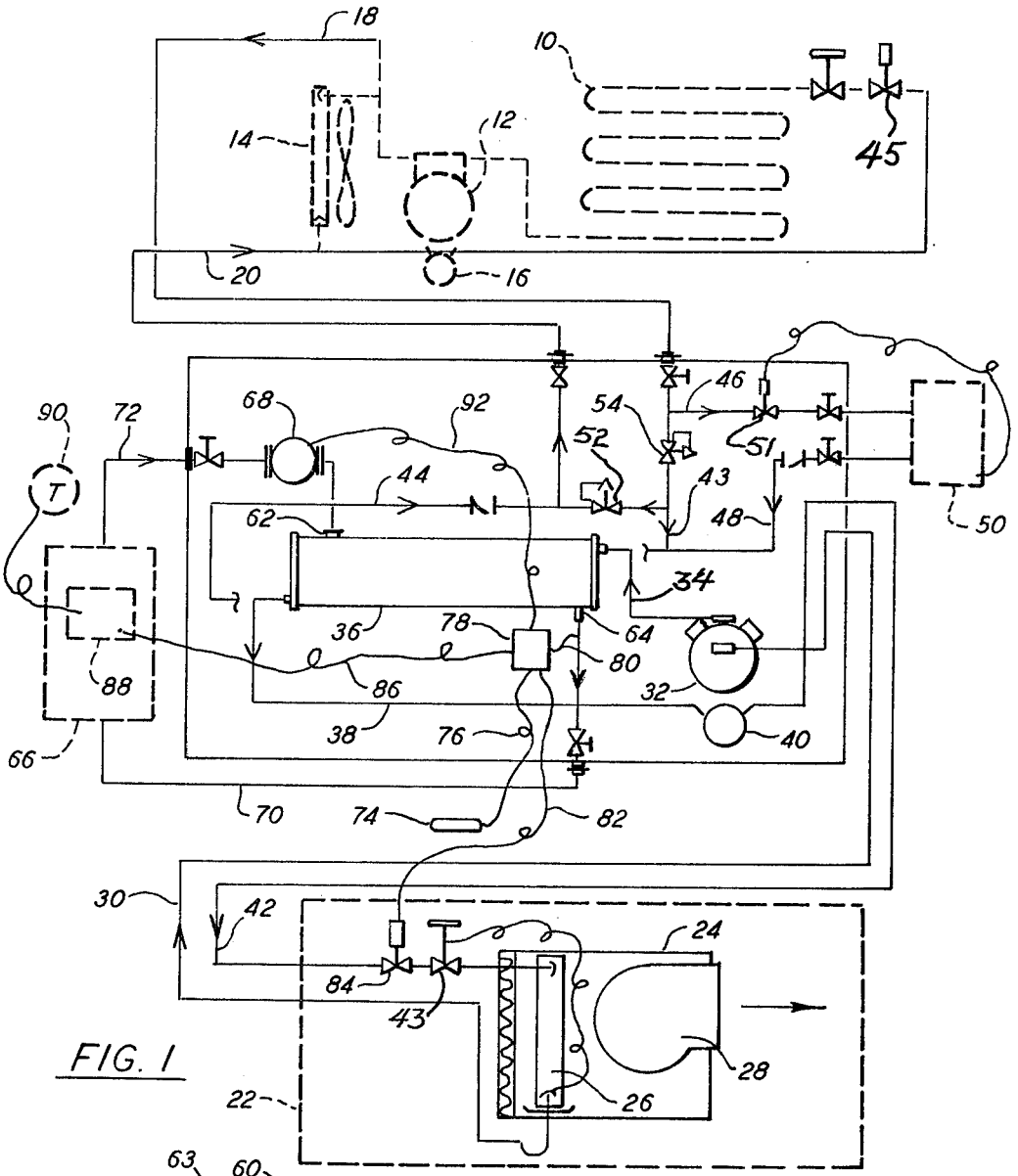
FIG. 1 is a diagrammatic illustration of the complete heating system of the invention.

Referring now to the drawing, the heat recovery and utilization system of the invention is shown diagrammatically in FIG. 1, and is intended to operate in conjunction with certain existing equipment and systems which, for ease of understanding, are shown in broken lines. Since the invention is employed in connection with a dairy operation, it is assumed that a conventional milk cooling system is available and includes cooling coils 10, compressor 12, air cooled condenser 14 and receiver 16. As employed in the present invention, the refrigerant lines are disconnected from the existing condenser and connected to supply and return lines 18 and 20, respectively, which lead to and from the condensing unit of the present invention.

The cows are housed in an enclosed barn, represented by block 22, wherein refrigerant evaporator unit 24 is installed. Evaporator 24 includes coil 26 and fan 28 which circulates barn air over the coil. As previously mentioned, during periods when the outside temperature is low enough to require residential heating, the barn temperature will be considerably higher due to the body heat given off by the cattle housed therein. The barn temperature is, of course, subject to many variables in addition to outside temperature, such as the number and size of cattle, the size, physical layout and weather tightness of the barn, wind factors, etc. However, for typical dairy operations where the size of the herd is sufficient to utilize all or most of the barn capacity, it may be assumed that the inside barn temperature will be on the order of 50° F. to 60° F. above the outside temperature.

Refrigerant suction gas from evaporation coil 26 is supplied through line 30 to compressor 32 where its pressure and temperature are increased to the necessary level. The refrigerant hot gas is then supplied through line 34 to condenser unit 36, described later in more detail. After giving up heat and returning to the liquid state in condenser 36, the refrigerant goes to receiver 40 and thence through return line 42, through expansion valve 43, where pressure drop occurs, to evaporator 26 where it is again heated and evaporated by barn air and the cycle is continued.

Refrigerant hot gas in supply line 18 has been heated by compression in the same manner as refrigerant in line 34 of the first-described circuit. It is likewise supplied via line 43 to condenser unit 36 where it gives up heat and thence to line 44 which is connected to return line 20, and through expansion valve 45, back evaporator coil 10. Hot refrigerant gas from supply line 18 is also connected by bypass supply and return lines 46 and 48, respectively, to a heat exchange coil within domestic hot water heater 50. Solenoid valve 51 is connected to temperature sensing means in heater 50 for movement to the open position in response thereto, allowing refrigerant hot gas to flow through the bypass lines as required for heating water which may be used in the dairy operation or as residential domestic hot water. Heater 50 may be of the type which absorbs the full heat of rejection of the milk cooler, or may remove the superheat only.

Throttling valves 52 and 54 serve as outlet and inlet regulators, respectively, for the refrigeration circuit supplying water heater 50. If the heating load is large and causes the receiver pressure to fall below a predetermined set point, valve 52 will partially open to raise the receiver pressure and maintain it at the minimum predetermined level. Valve 54 likewise operates to maintain compressor discharge pressure at a predetermined set point. When inlet pressure rises above the set point, valve 54 partially opens.

Figure 2:
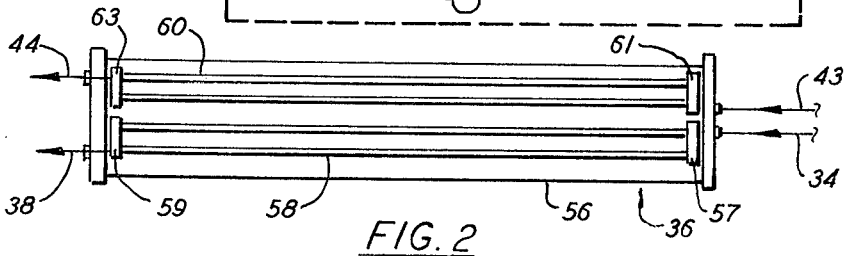
FIG. 2 is a plan view of one of the elements of FIG. 1.
Figure 3:
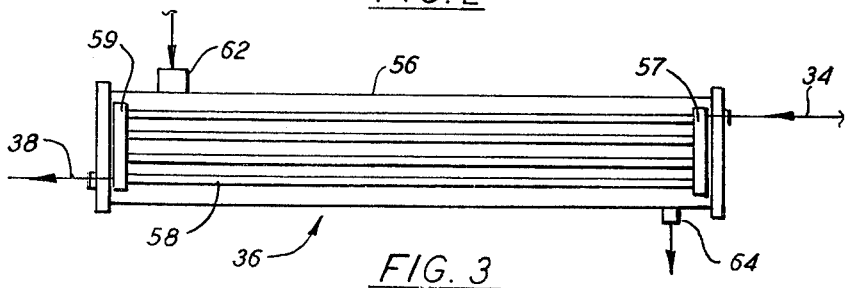
FIG. 3 is a side elevational view of the unit of FIG. 2.

Turning now to FIGS. 2 and 3, the internal structure of condenser unit 36 is shown in more detail. The unit includes outer shell or tank 56 containing two condensing tube bundles 58 and 60. All tubes of bundle 58 communicate at one end with inlet manifold 57 and at the other end with outlet manifold 59. Likewise, the tubes of bundle 60 communicate at opposite ends with inlet and outlet manifolds 61 and 63, respectively. Inlet line 34 supplies refrigerant of one circuit to manifold 57 and tubes 58, as refrigerant of the other circuit is supplied to manifold 61 and tubes 60 through inlet line 43. The refrigerants circulate through the respective condensing tubes to outlet manifolds 59 and 63 and leave unit 36 through outlet lines 38 and 44. Water enters and leaves tank 56 through inlet and outlet openings 62 and 64, respectively, circulating over both sets of tubes 58 and 60, thereby absorbing heat from the two refrigerants contained therein. Greater heating efficiency is obtained by the counter-flow action of water and refrigerant, with water at the lowest temperature entering at inlet 62 contacting the condensing tubes in the area where refrigerant is at its lowest temperature, and water leaving the condenser unit contacting the tubes and manifold at the high (140°–160° F.) temperature end.

The water which is heated in condenser unit 36 is used to provide or supplement an existing residential heating system, indicated generally by block 66. The water is circulated by pump 68, entering and leaving the heating system through supply and return lines 70 and 72, respectively. The heat from the water may be supplied to the residence in any desired manner, such as baseboard or radiant hot water heating systems, or in existing hot air systems by placing a coil through which the hot water circulates in the return air plenum or a return air duct of the heating system. The condenser temperature of the refrigerants in each circuit is the same, although evaporation temperatures may be different.

A control system is provided for relating the temperature of water leaving condenser to outside air temperature, and for supplying water to the heating system only when required for inside heating purposes. Outside temperature sensor 74 develops an electrical signal commensurate with the level of outside air temperature which is provided as a first input on line 76 to control box 78. A second input, commensurate with the temperature of water from condenser outlet 64, is supplied to the control box on line 80. If the water temperature is warmer than required for heating purposes in accordance with current outside temperature, an output signal on line 82 will cause solenoid valve 84 to close. When liquid refrigerant is not supplied to evaporator coil 26, compressor 32 will pump down and the refrigerant circuit will cease to provide heat to condenser 36 until the water temperature drops to a level, relative to outside temperature, indicating that additional heat is required.

A separate input to control box 78 is provided on line 86 from the existing heating system control 88. When inside temperature of the space to be heated falls below the value set on inside thermostat 90, the output signal on line 92 will turn on pump 68. Likewise, whenever inside temperature is at or above the level selected on thermostat 90, pump 68 will operate to circulate water through condenser 36 and heating system 66.

What is claimed is:

1. A method of collecting and utilizing heat generated in connection with a dairy operation wherein cows are housed in a barn the inside temperature of which is significantly raised above outside temperature by the cows' body heat, said method comprising:

(a) positioning a first evaporator within the barn and circulating therethrough a first refrigerant for absorbing heat from the barn air;

(b) positioning a second evaporator within a milk cooling tank and circulating therethrough a second refrigerant for absorbing heat from the milk;

(c) connecting said first evaporator in a continuous circuit with a first condenser coil;

(d) connecting said second evaporator in a continuous circuit with a second condenser coil; and (e) circulating water over both said first and second condenser coils for absorbing heat from said first and second refrigerants.

2. The method of claim 1 and further including circulating the heated water through space heating means.

3. The method of claims 1 or 2 wherein both said first and second condenser coils are positioned within a single tank through which water is circulated for absorbing heat simultaneously from said first and second refrigerants.

4. The method of claims 1 or 2 and further including connecting a third condenser coil in at least one of said continuous circuits and positioning said third coil in a tank for heating domestic hot water.

5. A system for recovering and utilizing heat in association with a dairy operation wherein cows are housed and milked in a barn and the milk is cooled in an existing cooling tank, said system comprising:

(a) a first continuous refrigeration circuit including first evaporator and condenser coils charged with a first refrigerant;

(b) a second continuous refrigeration circuit including second evaporator and condenser coils charged with a second refrigerant;

(c) said first evaporator coil being positioned in the barn, whereby said first refrigerant is heated by body heat from cows which is given off to the barn air;

(d) said second evaporator coil being positioned in the milk cooling tank, whereby said second refrigerant is heated by the milk;

(e) a single condenser tank wherein both of said first and second condenser coils are positioned; and (f) inlet and outlet means on said condenser tank through which water is circulated to pass over said first and second condenser coils, thereby absorbing heat from said first and second refrigerants.

6. The invention according to claim 5 and further including space heating means through which the water heated in said condenser tank is circulated.

7. The invention according to claim 6 and further including means for varying the temperature of water leaving said condenser tank in response to outside air temperature.

8. The invention according to claims 5, 6 or 7 and further including fan means for circulating barn air over said first evaporator coil.

9. The invention according to claim 5 and further including a third condenser coil connected in one of said continuous refrigeration circuits and a second condenser tank wherein said third coil is positioned, said second tank including inlet and outlet means through which water is circulated to pass over said third coil and absorb heat from the refrigerant therein.

10. The invention according to claim 9 wherein said third condenser coil is connected in said second refrigeration circuit.

11. The invention according to claim 9 and further including a bypass line connecting said third condenser tube in said second refrigeration circuit and a valve in said bypass line for movement between an open position, wherein refrigerant is circulated through both said second and third condenser coils, and a closed position, wherein refrigerant is circulated only to said second condenser coil.

* * * * *